US009877116B2

(12) United States Patent
Udesen

(10) Patent No.: US 9,877,116 B2
(45) **Date of Patent: *Jan. 23, 2018**

(54) HEARING DEVICE WITH POSITION DATA, AUDIO SYSTEM AND RELATED METHODS

(71) Applicant: GN HEARING A/S, Ballerup (DK)

(72) Inventor: Jesper Udesen, Malov (DK)

(73) Assignee: GN Hearing A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 14/576,160

(22) Filed: Dec. 18, 2014

(65) Prior Publication Data

US 2015/0189449 A1 Jul. 2, 2015

(30) Foreign Application Priority Data

Dec. 30, 2013 (DK) ..... 2013 70828
Dec. 30, 2013 (EP) ..... 13199857

(51) Int. Cl.
*H04R 25/00* (2006.01)

(52) U.S. Cl.
CPC ..... *H04R 25/43* (2013.01); *H04R 25/552* (2013.01); *H04R 25/554* (2013.01);
(Continued)

(58) Field of Classification Search
CPC .. H04R 2460/07; H04R 2225/55; H04R 5/02; H04R 25/43; H04R 25/552;
(Continued)

(56) References Cited

U.S. PATENT DOCUMENTS 6,845,338 B1 1/2005 Willins et al.
7,072,480 B2 7/2006 Rass
(Continued)

FOREIGN PATENT DOCUMENTS

EP 1 638 367 A2 3/2006
EP 2 584 794 A1 4/2013
(Continued)

OTHER PUBLICATIONS

Extended European Search Report dated Mar. 27, 2014, for related European Application No. 13199857.7, 7 pages.
(Continued)

*Primary Examiner* — Davetta W Goins
*Assistant Examiner* — Oyesola C Ojo
(74) *Attorney, Agent, or Firm* — Vista IP Law Group

(57) ABSTRACT

A method of operating a hearing device comprising a first antenna, a first transceiver coupled to the first antenna, an acoustic output transducer, a microphone, and a processing unit, the processing unit being coupled to the first transceiver, the acoustic output transducer, and the microphone, the method includes: pairing the hearing device with an audio system; initiating detection of hearing device motion; sending position data indicative of a position of the hearing device to the audio system; wirelessly receiving a first audio stream based on the position data; converting the first audio stream to a first wireless input signal; mixing the first wireless input signal with an audio input signal from the microphone of the hearing device to form a mixed signal; processing the mixed signal to form an output signal; and converting the output signal to an audio output signal.

19 Claims, 6 Drawing Sheets

(52) U.S. Cl.
CPC ..... *H04R 2225/55* (2013.01); *H04R 2460/03* (2013.01); *H04R 2460/07* (2013.01)

(58) Field of Classification Search
CPC ..... H04R 2460/03; H04R 25/554; H04R 2225/021; H04R 2225/023; H04R 2225/025
USPC ..... 381/315, 313
See application file for complete search history.

(56) References Cited

U.S. PATENT DOCUMENTS

| | | | | |
|---|---|---|---|---|
| 9,078,070 | B2 * | 7/2015 | Samuels | H04R 25/00 |
| 9,374,647 | B2 * | 6/2016 | Han | H04R 1/1041 |
| 2004/0156512 | A1 | 8/2004 | Parker | |
| 2005/0094834 | A1 | 5/2005 | Chalupper | |
| 2008/0080705 | A1 | 4/2008 | Gerhardt et al. | |
| 2008/0165994 | A1 | 7/2008 | Caren | |
| 2009/0052703 | A1 * | 2/2009 | Hammershoi | H04S 7/302 381/310 |
| 2011/0293123 | A1 | 12/2011 | Neumeyer et al. | |
| 2011/0299707 | A1 | 12/2011 | Meyer | |
| 2013/0094683 | A1 | 4/2013 | Hansen | |
| 2013/0177187 | A1 | 7/2013 | Mentz | |
| 2013/0315425 | A1 | 11/2013 | Lunner | |
| 2013/0316679 | A1 | 11/2013 | Miller et al. | |
| 2013/0343584 | A1 | 12/2013 | Bennett et al. | |
| 2014/0056452 | A1 * | 2/2014 | Moss | H04R 25/30 381/323 |
| 2015/0003653 | A1 * | 1/2015 | Recker | H04R 25/40 381/315 |
| 2015/0124975 | A1 * | 5/2015 | Pontoppidan | H04R 25/552 381/23.1 |
| 2015/0189453 | A1 | 7/2015 | Udesen et al. | |

FOREIGN PATENT DOCUMENTS

| | | | |
|---|---|---|---|
| EP | 2 675 189 | A1 | 12/2013 |
| WO | WO 2007/112756 | A2 | 10/2007 |
| WO | WO 2007/112756 | A3 | 10/2007 |
| WO | WO 2009/118424 | A2 | 10/2009 |
| WO | WO 2012/177139 | A2 | 12/2012 |

OTHER PUBLICATIONS

First Danish Office Action and Search Report dated Sep. 12, 2014, for related Danish Patent Application No. PA 2013 70828, 4 pages.
Extended European Search Report dated Apr. 2, 2014, for related EP Patent Application No. 13199856.9, 6 pages.
First Technical Examination and Search Report dated Aug. 15, 2014, for related Danish Patent Application No. PA 2013 70827, 6 pages.
Non-final Office Action dated Jun. 30, 2016 for related U.S. Appl. No. 14/579,308.
Final Office Action dated Mar. 13, 2017 for related U.S. Appl. No. 14/579,308.
Non-Final Office Action dated Nov. 2, 2017 for related U.S. Appl. No. 14/579,308.

* cited by examiner

HEARING DEVICE WITH POSITION DATA, AUDIO SYSTEM AND RELATED METHODS

RELATED APPLICATION DATA

This application claims priority to and the benefit of Danish Patent Application No. PA 2013 70828 filed on Dec. 30, 2013, pending, and European Patent Application No. 13199857.7 filed on Dec. 30, 2013, pending. The entire disclosures of both of the above applications are expressly incorporated by reference herein.

FIELD

The present disclosure relates to a method of operating a hearing device, a hearing device, and a method for operating an audio system. In particular, the present disclosure relates to methods and apparatus for improving the correspondence of the visual and the auditory cues of a hearing aid user in a crowded environment.

BACKGROUND

It is known to stream audio to hearing devices via a telecoil solution having a limited bandwidth with limited possibilities of separating different audio streams. Further, wireless communication to and from hearing devices has been increasing in continuation of the developments within wireless communication technology. In an environment where audio is distributed to the crowd via a number of external microphones or other audio sources the present technology provides limited possibilities of separating audio signals from different positions.

SUMMARY

There is a need for a hearing device that improves separation of audio signals from different audio sources.

Despite the known solutions there is still a need for improved user experience in a crowded area with multiple microphones/audio sources.

Accordingly, a method of operating a hearing device is provided. The hearing device comprises a first antenna, a first transceiver coupled to the first antenna, an acoustic output transducer, a microphone, and a primary processing unit, the primary processing unit being coupled to the first transceiver, the acoustic output transducer, and the microphone. The method comprises pairing the hearing device with an audio system; initiating detection of hearing device motion; sending position data indicative of hearing device position to the audio system; wirelessly receiving a first audio stream based on the position data of the hearing device; converting the first audio stream to a first wireless input signal; mixing the first wireless input signal with an audio input signal from the microphone to form an input signal; processing the input signal to form an output signal; and converting the output signal to an audio output signal.

Furthermore a hearing device is provided. The hearing device comprises a first antenna; a first transceiver coupled to the first antenna and configured to wirelessly receive one or more audio streams from an audio system, the one or more audio streams including a first audio stream, wherein the hearing device is configured for pairing the hearing device with the audio system; a microphone; a primary processing unit adapted for processing an input signal according to a hearing prescription in order to alleviate a hearing loss; an acoustic output transducer coupled to an output of the primary processing unit for conversion of an output signal from the primary processing unit into an audio output signal; a secondary processing unit with a first input and a second input, wherein the first input is coupled to an output of the first transceiver for receiving a first wireless input signal representative of the first audio stream from the first transceiver, and the second input is coupled to an output of the microphone for receiving an audio input signal from the microphone, wherein the secondary processing unit is configured to mix the first wireless input signal and the audio input signal to form an input signal on an output of the secondary processing unit, wherein the output of the secondary processing unit is coupled to the input of the primary processing unit; and a position controller configured for detecting and sending position data of the hearing device to the audio system.

Furthermore, a method of operating an audio system is provided. The audio system comprises one or more audio sources including a first audio source optionally with a microphone, the audio system comprising a first antenna, a first transceiver coupled to the first antenna, and a processing unit, the processing unit being coupled to the first transceiver. The method comprises pairing the audio system with a hearing device; receiving position data indicative of hearing device position; receiving input signal(s) from the one or more audio sources including a first input signal from the first audio source, processing the input signal(s) based on position data of the hearing device to form a first wireless output signal; and sending a first audio stream to the hearing device based on the first wireless output signal.

It is an advantage that the audio stream received in the hearing device is based on the position (direction and/or distance) of the hearing device, thereby improving the user experience of the hearing device. Thus, the position (distance and/or orientation) of the hearing device may provide prioritization of audio signals.

Further, the disclosed hearing device and methods improve the correspondence of the visual and the auditory cues of the listener, otherwise lost in crowd amplification.

The primary processing unit and/or the secondary processing unit of the hearing device may be configured to compensate for hearing loss or hearing disability of the user of the hearing device. The primary processing unit and/or the secondary processing unit of the hearing device may be configured to alter a received audio stream, e.g. the first audio stream, a wireless input signal, e.g. the first wireless input signal, and/or the input signal to compensate for hearing loss or hearing disability of the user of the hearing device.

The hearing device comprises a secondary processing unit and a primary processing unit. The secondary processing unit and the primary processing unit may be embedded as a single processing unit performing the tasks of both the secondary processing unit and the primary processing unit.

A method of operating a hearing device comprising a first antenna, a first transceiver coupled to the first antenna, an acoustic output transducer, a microphone, and a processing unit, the processing unit being coupled to the first transceiver, the acoustic output transducer, and the microphone, the method includes: pairing the hearing device with an audio system; initiating detection of hearing device motion; sending position data indicative of a position of the hearing device to the audio system; wirelessly receiving a first audio stream based on the position data; converting the first audio stream to a first wireless input signal; mixing the first wireless input signal with an audio input signal from the microphone of the hearing device to form a mixed signal;

processing the mixed signal to form an output signal; and converting the output signal to an audio output signal.

Optionally, the position data is sent to the audio system if a position change criterion is fulfilled.

Optionally, the act of initiating the detection of the hearing device motion comprises setting up a reference coordinate system.

Optionally, the position data comprises angular position data of the hearing device.

Optionally, the position data are sent via the first transceiver.

Optionally, the hearing device comprises a second antenna, and wherein the position data are sent via the second antenna.

Optionally, the hearing device comprises a second antenna, and wherein the act of pairing the hearing device with the audio system is performed via the second antenna.

A hearing device includes: a first antenna; a first transceiver coupled to the first antenna and configured to wirelessly receive one or more audio streams from an audio system, the one or more audio streams including a first audio stream, wherein the hearing device is configured for pairing the hearing device with the audio system; a microphone; a primary processing unit configured for processing an input signal according to a hearing prescription in order to alleviate a hearing loss; an acoustic output transducer coupled to the primary processing unit for conversion of an output signal from the primary processing unit into an audio output signal; a secondary processing unit with a first input and a second input, wherein the first input is coupled to an output of the first transceiver for receiving a first wireless input signal representative of the first audio stream, and the second input is coupled to an output of the microphone for receiving an audio input signal from the microphone, wherein the secondary processing unit is configured to mix the first wireless input signal and the audio input signal to form a mixed signal, and wherein the secondary processing unit has an output for providing the mixed signal to the primary processing unit; and a position controller configured for detecting and sending position data of the hearing device to the audio system.

Optionally, the position controller comprises a motion detector and a position estimator connected to the motion detector, the position estimator configured to estimate the position data of the hearing device based on an output from the motion detector.

A method of operating an audio system comprising one or more audio sources including a first audio source, the audio system comprising a first antenna, a first transceiver coupled to the first antenna, and a processing unit, the processing unit being coupled to the first transceiver, the method includes: pairing the audio system with a hearing device; receiving position data indicative of a position of the hearing device; receiving input signal(s) from the one or more audio sources including a first input signal from the first audio source; processing the input signal(s) based on the position data to form a first wireless output signal; and sending a first audio stream to the hearing device based on the first wireless output signal.

Optionally, the method further includes obtaining position data of the first audio source; wherein the act of processing the input signal(s) is also based on the position data of the first audio source.

Optionally, the one or more audio sources comprise a second audio source, wherein the act of receiving the input signal(s) from the one or more audio sources comprises receiving a second input signal from the second audio source, and wherein the first wireless output signal is based on the first input signal and the second input signal.

Optionally, the method further includes obtaining position data of the second audio source; wherein the act of processing the input signal(s) comprises processing the first input signal from the first audio source and the second input signal from the second audio source, and wherein the act of processing the input signal(s) is also based on the position data of the second audio source.

Optionally, the hearing device is a binaural hearing device comprising a first hearing device and a second hearing device; wherein the first wireless output signal comprises a first primary wireless output signal and a first secondary wireless output signal; and wherein the act of sending the first audio stream to the hearing device comprises sending the first primary audio stream to the first hearing device and sending the first secondary audio stream to the second hearing device.

Other features and embodiments will be described below in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
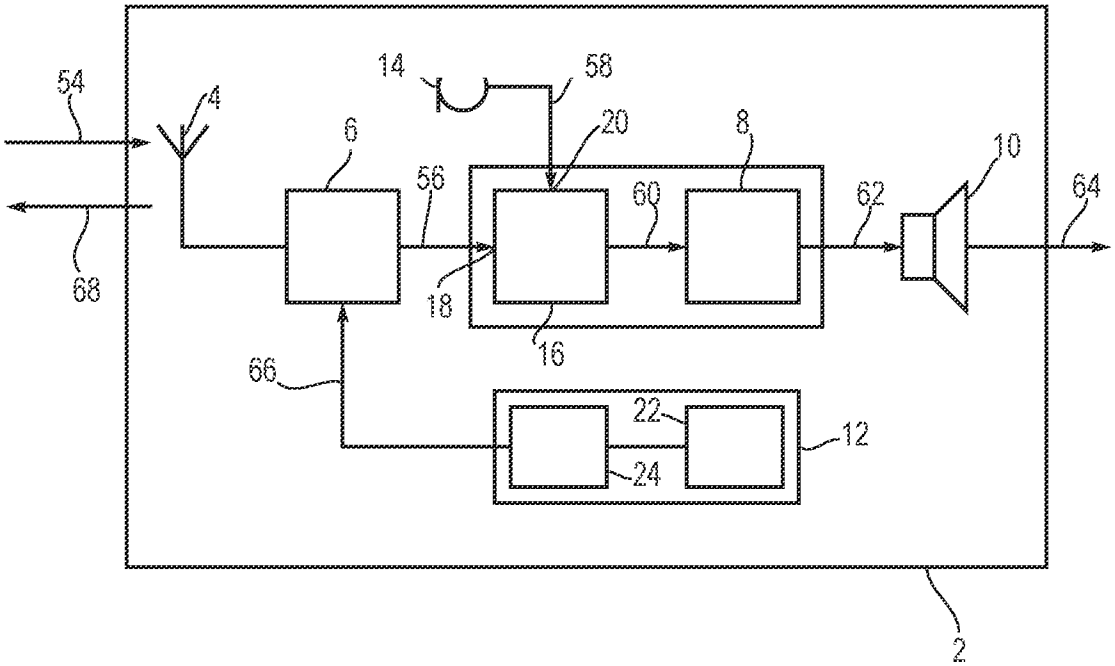
FIG. 1 schematically illustrates an exemplary hearing device.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described. Throughout, the same reference numerals are used for identical or corresponding parts.

The present disclosure relates to a hearing device, audio system and methods enabling adaptation of signal processing in the hearing device based on position data of the hearing device In an audio system, one or more transceivers or transmitter units comprising transceivers are configured for broadcasting or transmitting audio track(s) and/or audio stream(s), e.g. to one or more hearing devices. The audio system may comprise a first transceiver and optionally a second transceiver. A transceiver may transmit one or more audio streams. A transceiver may be identified by a transceiver address. A transmitter unit may be configured to wirelessly transmit audio track(s) and/or audio stream(s).

An audio track is an audible signal. Exemplary audible signals are speech, music, an airport call, a movie sound track or a combination thereof.

An audio stream is an electromagnetic signal representative of an audio track. An audio stream is represented by a number of audio blocks each comprising one or more audio packets. An audio packet comprises a finite part of an audio stream.

An audio packet may comprise an audio stream identifier, which may comprise one or more elements such as audio track identification, transceiver address or identification, audio group identification, audio source identification, etc. Audio track identification may enable selection of audio streams representative of the same audio track, and audio group identification may identify a certain group of audio tracks or audio streams e.g. an audio group may be audio tracks in the same or similar language, e.g. English, Danish or Chinese.

An audio packet may comprise transceiver address of the transceiver transmitting the audio packet, thus enabling the hearing device to sort out or separate audio packets sent from other transceivers.

Transmitting and receiving the wireless audio stream(s) may be achieved by using wireless technology, thus transmitting/receiving audio blocks at one or more frequencies, e.g. in the range from 2.4 GHz to 2.5 GHz, in the range from 800 MHz to 1 GHz, in the range from 3.6 GHz to 3.7 GHz, and/or in the range from 4.9 GHz to 5.9 GHz.

The primary processing unit may be configured to control the first transceiver. The first transceiver and/or the second transceiver may be configured to receive audio streams at frequencies in the range from 2.4 GHz to 2.5 GHz, in the range from 800 MHz to 1 GHz, in the range from 3.6 GHz to 3.7 GHz, and/or in the range from 4.9 GHz to 5.9 GHz. The first transceiver and/or the second transceiver may be configured to receive audio streams at frequencies in the range from 169 MHz to 218 MHz and/or in the range from 480 MHz to 520 MHz.

Pairing of the hearing device with the audio system, e.g. with the one or more audio sources of the audio system, may comprise transmitting hearing device information from the hearing device to the audio system. The hearing device information may comprise one or more of hearing device identification, hearing device manufacturer, hearing device model, and/or hearing device configuration data. Pairing of the hearing device with the audio system may additionally or alternatively comprise transmitting audio system information from the audio system to the hearing device and/or receiving audio system information from the audio system. The audio system information may comprise one or more of audio system identification, audio source identification(s), transceiver identification(s) and/or audio stream configuration data.

The audio system may be configured to adapt the format of the first audio stream to be sent to the hearing device based on hearing device information received from the hearing device, e.g. model and/or manufacturer, data encoding format etc. Furthermore, pairing of the hearing device with the audio system may comprise exchanging an encryption key, such as to enable encryption of an audio stream, such as the first audio stream, before sending from the audio system, and decryption of the received wireless input signal, e.g. the first wireless input signal, in the hearing device.

Pairing of the hearing device with the audio system may initiate sending of an audio stream, e.g. the first audio stream, from the audio system.

Pairing of the hearing device with the audio system may cause the hearing device to initiate receiving a wireless input signal, e.g. the first wireless input signal, which is sent by the audio system.

The position controller may be coupled to the primary processing unit for receiving and/or sending position control signal(s) from/to the primary processing unit.

The hearing device may comprise a second transceiver and/or a second antenna. The second transceiver and/or the second antenna may be coupled to the position controller.

The second transceiver and/or the second antenna may be coupled to the primary processing unit.

Pairing of the hearing device with the audio system may be performed via the first transceiver and/or the second transceiver of the hearing device.

The hearing device sends position data indicative of hearing device position to the audio system or device(s) in the audio system. The hearing device may send position data indicative of hearing device position to the audio system via another hearing device or a peripheral or external device, such as a smartphone or a tablet computer. Thus, the first transceiver and/or the second transceiver may be configured to transmit and/or receive wireless signals from/to one or more audio systems or other external devices, such as other hearing devices, mobile phones, or tablet computers.

The hearing device may send position data indicative of hearing device position to the audio system with the first transceiver and/or the second transceiver.

The position controller of the hearing device may comprise a motion detector and optionally a position estimator connected to the motion detector. The position estimator may be configured to estimate position data of the hearing device, e.g. based on motion detector output from a motion detector. The motion detector may comprise a plurality of sensors e.g. one or more gyroscopes and/or one or more accelerometers.

Position data of the hearing device and/or position data from audio source(s) may be sent continuously or regularly with a fixed time interval, e.g. every 100 ms, or every 500 ms, or every 1000 ms. Alternatively, or additionally, position data may be sent to the audio system if a position change criterion is fulfilled. For example, the hearing device may detect that the position is changing, and when the hearing device detects that the position is changing, the new position is sent to the first external device. The change criterion may e.g. be a change in the azimuth angle larger than a change threshold. The change threshold may be more than 0.5 degrees, or more than 1 degree, or more than 2 degrees, or more than 5 degrees. In another exemplary method and/or hearing device, the position data may be sent to the audio system if the position change criterion is fulfilled and at least by a fixed time interval, e.g. every 100 ms, or every 500 ms, or every 1000 ms. Thereby, the position data are updated regularly, but more frequently by a detection of change.

The audio system may receive position data correspondingly to the sending of position data from the hearing device.

It may be beneficial to limit the amount of data transmitted from the hearing device due to the limited battery capabilities of a hearing device. Reducing the necessity of sending position data, e.g. by sending position data only if a position change criterion is fulfilled, reduces the power consumption of the hearing device.

Initiating detection of hearing device motion may comprise setting up a reference coordinate system. Initiating detection of hearing device motion may comprise a calibration procedure where information of an initial alignment of the hearing device and the audio source(s) are determined. The calibration procedure may comprise setting up a reference coordinate system. The setting up of a reference coordinate system may comprise registering absolute position data of the hearing device and/or the audio source(s), e.g. while the user of the hearing device is looking in a predetermined (reference) direction and/or at a given (reference) distance, such as looking at a specific audio source or other reference at a predetermined distance. The reference coordinate system may have an origin at a specific point in relation to an audio source and/or the hearing device.

The position data may comprise angular position data of the hearing device. For example, the position data may comprise information of the azimuth angle of the hearing device. The azimuth angle may be indicative of the looking direction of the user wearing the hearing device. Alternatively, or additionally, the position data may comprise information of the altitude angle.

The position data may comprise distance position data of the hearing device. For example, the position data may comprise information of the distance of the hearing device relative to an audio source and/or a reference point.

The position data may be sent via the first transceiver and/or the first antenna of the hearing device. Alternatively or additionally, the position data may be sent via a second transceiver of the hearing device. The hearing device may comprise a second antenna. The second transceiver may be coupled to the second antenna. The position data may be sent via the second antenna. Pairing the hearing device with one or more devices of an audio system may be performed via the second antenna.

The audio system comprises one or more audio sources including the first audio source and optionally a second audio source. The audio system may comprise a third audio source and/or a fourth audio source. The first audio source may comprise a first microphone. The second audio source may comprise a second microphone. The audio system may comprise a central unit with the processor and the first transceiver. The audio source(s) may be wired and/or wirelessly coupled to the central unit for feeding input signals to the processor.

The method of operating an audio system may comprise receiving a plurality of input signals from respective plurality of audio sources, such as receiving a first input signal from the first audio source, and/or receiving a second input signal from the second audio source.

The method of operating an audio system may further comprise processing input signals from the plurality of audio sources, e.g. the first audio source and the second audio source, i.e. the first input signal and the second input signal. Processing of the input signals may be based on position data of the hearing device to form the first wireless output signal.

Processing the input signal(s) based on position data of the hearing device may comprise determining one or more gains, including a first gain for the first input signal and/or a second gain for the second input signal, based on position data of the hearing device, and applying the gain(s) to respective input signal(s) from audio source(s).

The method of operating the audio system may comprise obtaining position data of one or more audio source(s), e.g. the first audio source and/or the second audio source. Position data of audio source(s) may be obtained during an audio system setup procedure. This is in particular useful, when the audio sources are stationary.

Processing of input signal(s) may be based on position data of the audio source(s). Processing of the first input signal may be based on position data of the first audio source and/or processing of the second input signal may be based on position data of the second audio source. For example, a movement detected by the hearing device may be caused by the user looking at a moving audio source, which preferably should not result in a change of the audio received in the hearing device. Processing of an input signal, such as the first input signal and/or the second input signal, to form the first wireless output signal may be based both on position data of the respective audio source(s), such as the first audio source and/or the second audio source, and the position data of the hearing device.

The hearing device may be a binaural hearing device system comprising a first hearing device and a second hearing device. Processing the input signal(s) may comprise processing the input signal(s) based on position data of the hearing device to form a first primary wireless output signal and a first secondary wireless output signal. The sending of a first audio stream to the hearing device may comprise sending a first primary audio stream to the first hearing device and sending a first secondary audio stream to the second hearing device.

The first primary wireless output signal and the first secondary wireless output may at least in part be based on a head-related-transfer-function (HRTF). This entails changes in both amplitude and phase differentially to different ears, which are then perceived by the user of the binaural hearing device as a more natural perception of the effect of head movement on hearing.

Processing the first input signal may comprise applying a first gain $G_1$ to the first input signal. The first gain $G_1$ may be applied to the first input signal to form the first wireless output signal. The first gain $G_1$ may be based on position data for the hearing device, e.g. given by:

$$G_1=f(P_{HD}),$$

where $P_{HD}$ is position data for the hearing device.

In an audio system with a plurality of audio sources, e.g. a first audio source and a second audio source, processing of the input signals from the plurality of audio sources may comprise applying a vector of gains. The vector of gains may comprise a gain for each of the input signals. The vector of gains $\underline{G}$ may be given by:

$$\underline{G}=\underline{f}(P_{HD})$$

The plurality of gains and/or the first gain may comprise further inputs, such as the position data of the audio source(s):

$$\underline{G}=\underline{f}(P_{HD},P_{AS}),$$

Where $P_{HD}$ is position data for the hearing device, $P_{AS}$ is position data for an audio source. In the case of a plurality of audio sources, $P_{AS}$ may be a vector with position data of each audio source.

Processing the first input signal may comprise setting the first gain to a first value if a first field of listening (FIL) criterion is fulfilled, i.e. if the position of the hearing aid indicates that the hearing aid user wishes to listen to the first audio source. Processing the first input signal may comprise setting the first gain to a second value if the first FIL criterion is not fulfilled. The first value may be larger than the second value.

The first FIL criterion may be based on the first view angle being the angle between the users direction of view and the direction from the hearing device to the first audio source. The first FIL criterion may be given by:

$$|\alpha_1|<T_{1,1},$$

where $\alpha_1$ is the first view angle and $T_{1,1}$ is a first threshold angle for the first audio source. The first threshold angle $T_{1,1}$ may be in the range from 15 to 60 degrees.

Processing the second input signal may comprise setting the second gain to a first value if a second field of listening (FIL) criterion is fulfilled, i.e. if the position of the hearing aid indicates that the hearing aid user wishes to listen to the second audio source. Processing the second input signal may comprise setting the second gain to a second value if the second FIL criterion is not fulfilled. The first value may be larger than the second value.

The second FIL criterion may be based on the second view angle being the angle between the users direction of view and the direction from the hearing device to the second audio source. The second FIL criterion may be given by:

$$|\alpha_2|<T_{2,1},$$

where $\alpha_2$ is the second view angle and $T_{2,1}$ is a first threshold angle for the second audio source. The first threshold angle $T_{2,1}$ may be in the range from 15 to 60 degrees.

FIG. 1 schematically illustrates an exemplary hearing device. The hearing device 2 comprises a first antenna 4, a first transceiver 6, a primary processing unit 8, an acoustic output transducer 10, a position controller 12, a microphone 14, and a secondary processing unit 16.

The hearing device 2 is configured to pair with an audio system including one or more audio sources. For example, pairing of the hearing device 2 with the one or more audio sources is achieved by pairing the hearing device 2 with the audio system.

The first transceiver 6 is coupled to the first antenna 4 and configured to wirelessly receive one or more audio streams including a first audio stream 54 from the audio system. The one or more audio streams are converted to respective wireless input signals, e.g. the first audio stream 54 is converted to a first wireless input signal 56.

The secondary processing unit 16 has a first input 18 and a second input 20. The first input 18 is coupled to an output of the first transceiver 6. The second input 20 is coupled to an output of the microphone 14. The secondary processing unit 16 receives the first wireless input signal 56 from the first transceiver 6 on the first input 18, and receives the audio input signal 58 from the microphone 14 on the second input 20. The secondary processing unit 16 is configured to mix the first wireless input signal 56 and the audio input signal 58 to form the input signal 60 on an output of the secondary processing unit 16.

The primary processing unit 8 processes the hearing device input signal 60 to form an output signal 62. The primary processing unit 8 has an input coupled to the output of the secondary processing unit 16. The primary processing unit 8 may perform signal processing such as noise reduction, filtering, amplification, etc. of the input signal 60. The primary processing unit 8 may perform signal processing of the input signal 60 to account for hearing disability of the user of the hearing device 2.

The secondary processing unit 16 and the primary processing unit 8 may be embedded as a single processing unit as indicated with the dotted box in FIG. 1

The acoustic output transducer 10 is coupled to an output of the primary processing unit 8 and receives an output signal 62 of the primary processing unit and converts the output signal 62 into an audio output signal 64. The audio output signal 64 is perceptible by the user of the hearing device 2.

The position controller 12 is configured for detecting and sending position data of the hearing device 2 to an audio system. The position controller 12 comprises a motion detector 22 and optionally a position estimator 24 configured for estimating position data of the hearing device based on an output of the motion detector 22. In an exemplary hearing device, motion detector output may be coupled directly to the transceiver 6. The position data of the hearing device 2 may be sent to the audio system via a first external device. In the depicted example, the position controller 12 transmits position data output signal 66 indicative of the position data to the first transceiver 6. The first transceiver 6 sends a wireless position data signal 68 based on the position data signal 66 via the first antenna 4 to the audio system either directly or via a first external device.

In an alternative exemplary hearing device (not shown), the wireless position data signal 68 may be sent to the audio system via a second transceiver and/or a second antenna in the hearing device.

Figure 2:
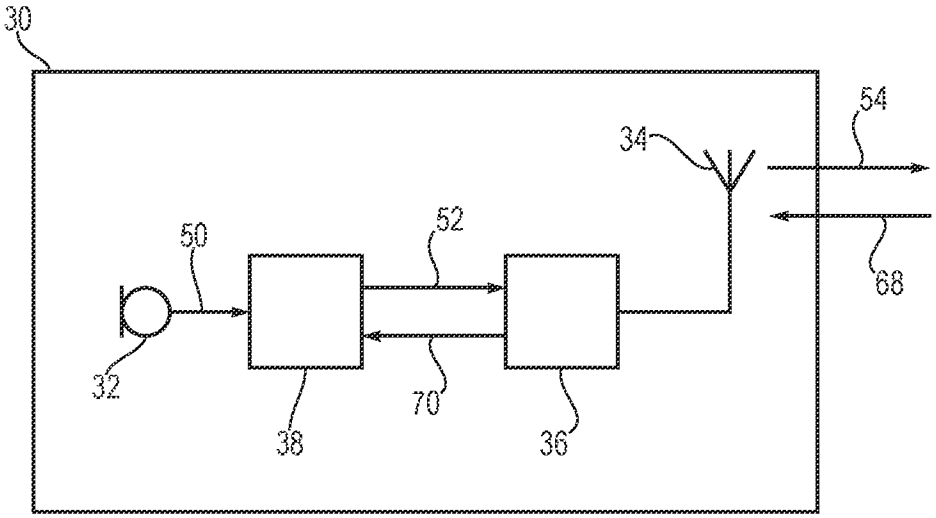
FIG. 2 schematically illustrates an exemplary hearing device.

FIG. 2 schematically illustrates an exemplary audio system 30. The audio system 30 comprises a first audio source 32, a processing unit 38, and a first transceiver 36 coupled to a first antenna 34. The processing unit 38 is coupled to the first transceiver 36. The first audio source 32 comprises a microphone and is connected to the processing unit 38.

The audio system 30 receives a first input signal 50 from the first audio source 32. The first input signal 50 is processed to form a first wireless output signal 52. A first audio stream 54 is sent to the hearing device 2 based on the first wireless output signal 52. The first audio stream 54 send by the audio system corresponds to the audio stream 54 received by the hearing device as illustrated in FIG. 1.

The audio system 30 receives wireless position data signal 68 from the hearing device 2, the wireless position data signal 68 is indicative of the position of the hearing device 2. The wireless position data signal 68 is received by the first transceiver 36 via the first antenna 34. The first transceiver transmits a position data input signal 70 based on the wireless position data signal 68 to the processing unit 38 of the audio system 30. The processing of the input signal 50 is based on the position data of the hearing device 2. Hence, the first wireless output signal 52 is adapted to the position of the hearing device 2.

In an alternative exemplary audio system (not shown), the wireless position data signal 68 may be received by a second transceiver and/or a second antenna in the audio system.

Figure 3:
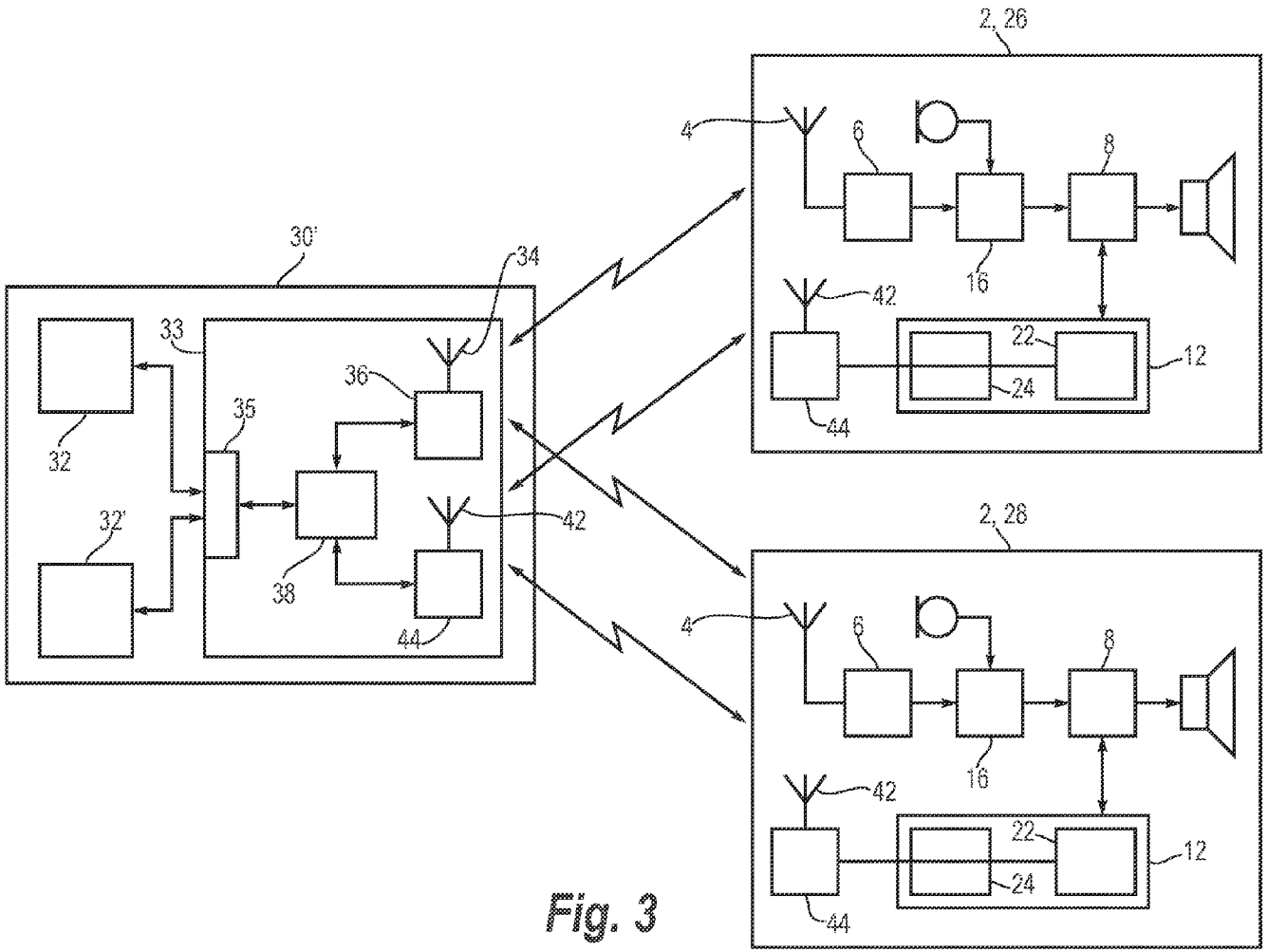
FIG. 3 schematically illustrates an exemplary audio system and an exemplary hearing device in the form of a binaural hearing device.

FIG. 3 schematically illustrates an exemplary audio system 30' and an exemplary hearing device system comprising a first hearing device 26 and a second hearing device 28. The first hearing device 26 and/or the second hearing device 28 may be a hearing device as disclosed herein, e.g. a hearing device 2. The audio system 30' comprises a first audio source 32 comprising a first microphone, and a second audio source 32' comprising a second microphone. The first audio source 32 and the second audio source 32' are wirelessly coupled to a central unit 33 with processor 38 via interface 35 for feeding first and second input signals to the processor. Processor 38 receives position data of one of or both hearing devices 26, 28 via second antenna 42 and second transceiver 44 in the audio system and processes the first and second input signals from audio sources 32, 32' based on the received hearing device position data to form a first primary wireless output signal and a first secondary wireless output signal. Hearing devices 26, 28 each comprises second antenna 42 and second transceiver 44 coupled to position controller 12 for sending position data to the audio system. The position controller 12 may be omitted in one of the hearing devices 26, 28. The first primary wireless output signal and the first secondary wireless output signal are sent to the first hearing device 26 and second hearing device 28, respectively, as a first primary audio stream to the first hearing device and a first secondary audio stream to the second hearing device via the first transceiver 36. The first primary wireless output signal and the first secondary wireless output signal may be multiplexed to a single first audio stream comprising first and second channels.

Figure 4:
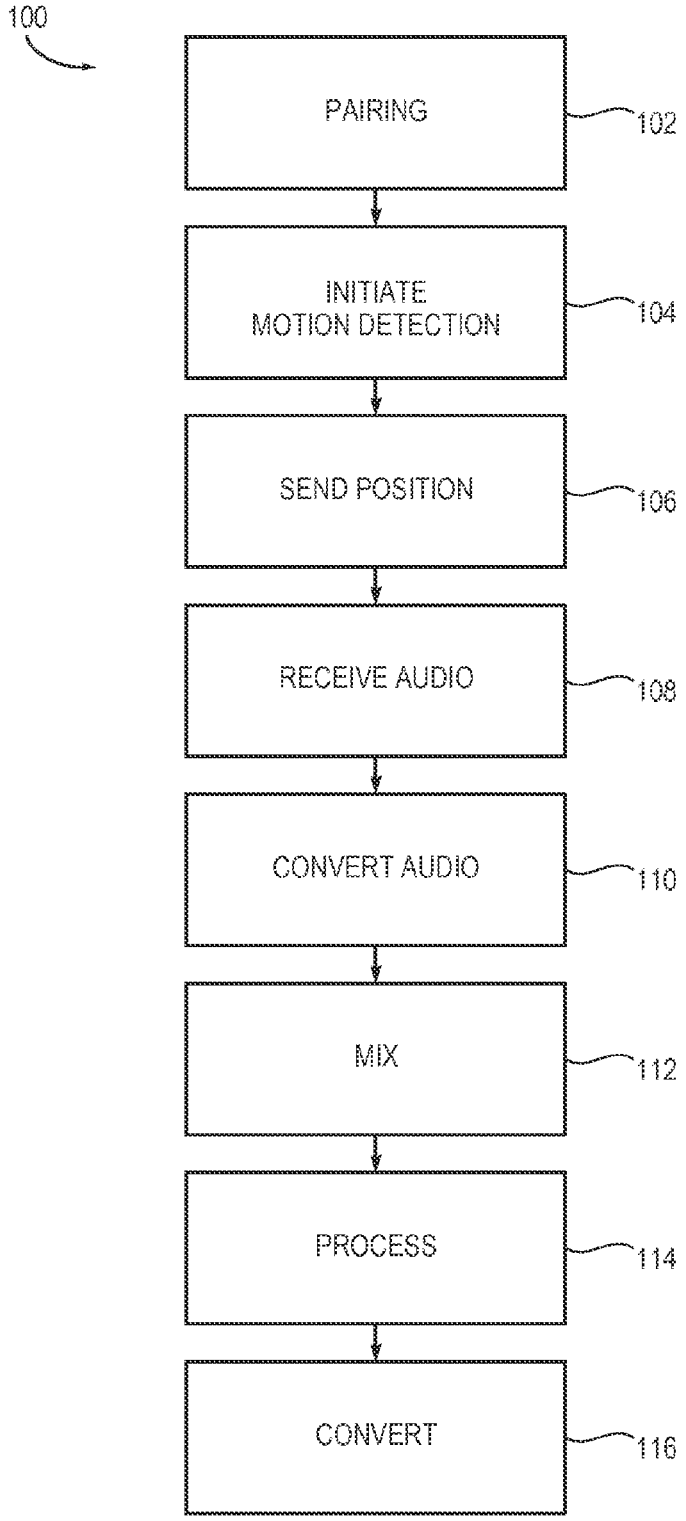
FIG. 4 is a flow diagram for an exemplary method for operating a hearing device.

FIG. 4 shows a flow diagram of an exemplary method 100 of operating a hearing device or a hearing device system. The method 100 comprises pairing 102 the hearing device with an audio system, initiating 104 detection of hearing device motion, sending 106 position data, receiving 108 audio stream(s), converting 110 audio stream(s) to wireless input signal(s), mixing 112 the wireless input signal(s) with audio input signal(s) to form input signal(s), processing 114 the input signal(s) to form output signal(s), and converting 116 the output signal(s) to audio output signal(s).

Pairing 102 the hearing device with the audio system may comprise pairing the hearing device with one or more audio sources of the audio system. Pairing of the hearing device with the audio system 102 may further comprise exchanging hearing device identification data, audio system identification data and/or audio source identification data, between the hearing device and the audio system.

Initiating 104 detection of hearing device motion may comprise activating motion detection in the hearing device. Sending 106 position data may comprise sending position data indicative of hearing device position to the audio system.

Receiving 108 audio stream(s) may comprise receiving a first audio stream based on the position data of the hearing device and/or receiving a second audio stream based on the position data of the hearing device.

Converting 110 audio stream(s) may comprise converting the first audio stream to a first wireless input signal and/or converting the second audio stream to a second wireless input signal.

Mixing 112 of wireless input signal(s) with audio input signal(s) to form input signal(s) may comprise mixing the first wireless input signal with an audio input signal from a microphone of the hearing device to form an input signal. Alternatively, or additionally, mixing 112 of wireless input signal(s) with audio input signal(s) to form input signal(s) may comprise mixing a plurality of wireless input signals, e.g. a first and a second wireless input signal, with one or more audio input signals, to form one or more input signals.

Processing 114 the input signal(s) to form output signal(s) may comprise applying signal processing to the input signal(s) e.g. filtering, amplification, noise reduction and/or adjustments to compensate for hearing loss or hearing disability of the user of the hearing device. Processing 114 of the input signal(s) to form output signal(s) may comprise processing of a first input signal to form a first output signal.

Converting 116 the output signal(s) to an audio output signal(s) may comprise converting a first output signal to a first audio output signal. The audio output signal(s) may be perceptible by the user of the hearing device.

It is emphasized that the method 100 may be looped, such that the hearing device is continuously sending position data 106, receiving audio stream(s) 108, converting audio stream(s) to wireless input signal(s) 110, mixing the wireless input signal(s) with audio input signal(s) to form input signal(s) 112, processing the input signal(s) to form output signal(s) 114, and converting the output signal(s) to audio output signal(s) 116. Further, different parts of the method may be run in parallel and/or sequentially.

Figure 5:
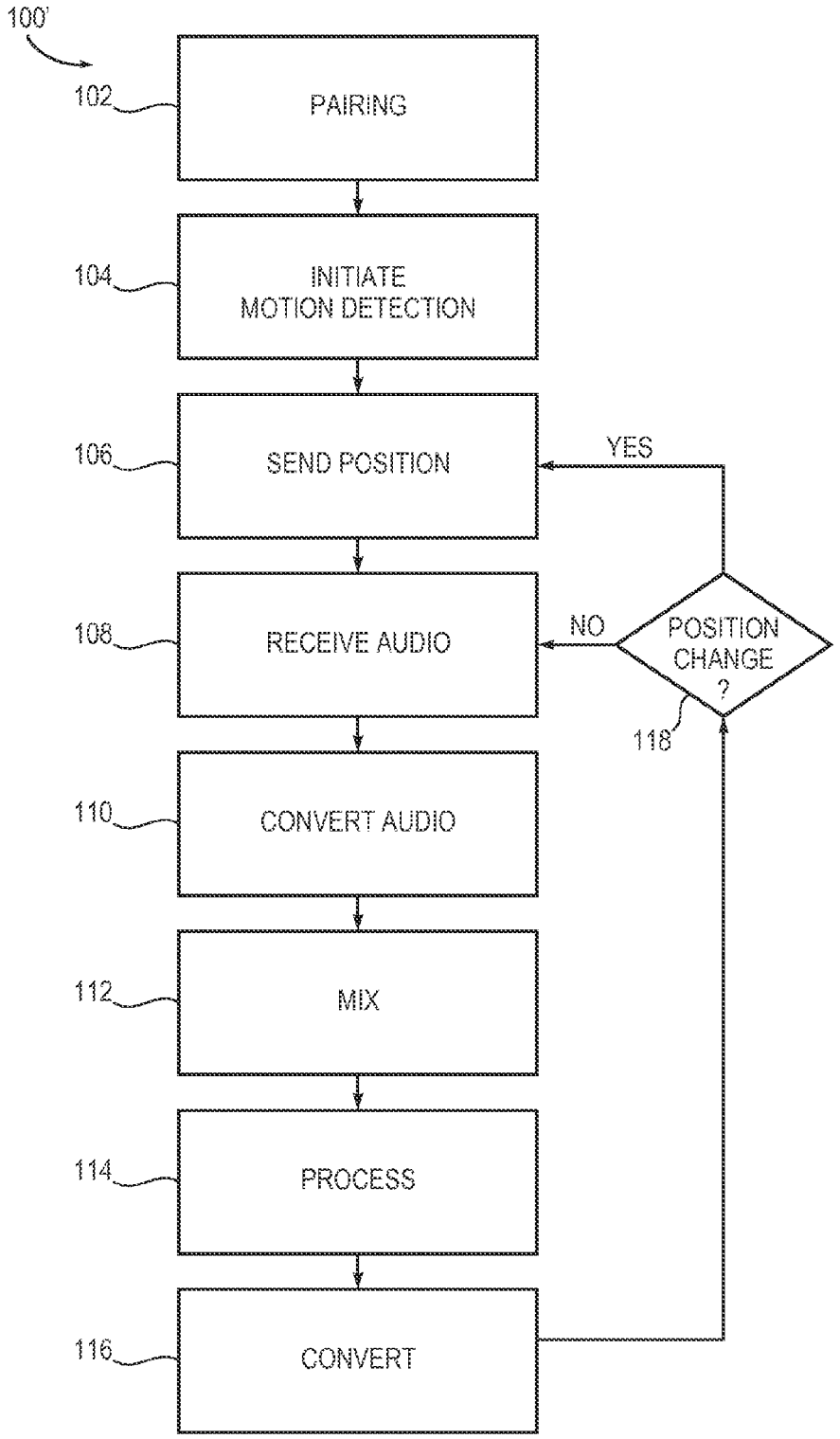
FIG. 5 is a flow diagram for an exemplary method for operating a hearing device.

FIG. 5 shows a flow diagram of an exemplary method 100' of operating a hearing device. The exemplary method 100' comprises the same steps as the method 100 as shown in FIG. 4. However, the method 100' illustrates the loop of the method, where the hearing device is continuously receiving audio stream(s) 108, converting audio stream(s) to wireless input signal(s) 110, mixing the wireless input signal(s) with audio input signal(s) to form input signal(s) 112, processing the input signal(s) to form output signal(s) 114, and converting the output signal(s) to audio output signal(s) 116.

The method 100' further comprises a position change criterion 118. If the position change criterion is fulfilled, the method 100' returns to sending position data 106. If the position change criterion is not fulfilled the method 100' returns to the receiving of audio stream(s) 108. The position change criterion 118 determines if a position change large enough to justify resending of position data in 106 has occurred. Incorporation of a position change criterion 118 may improve battery life of the hearing device by reducing the amount of wireless data transmission from the transceiver of the hearing device to the audio system.

Figure 6:
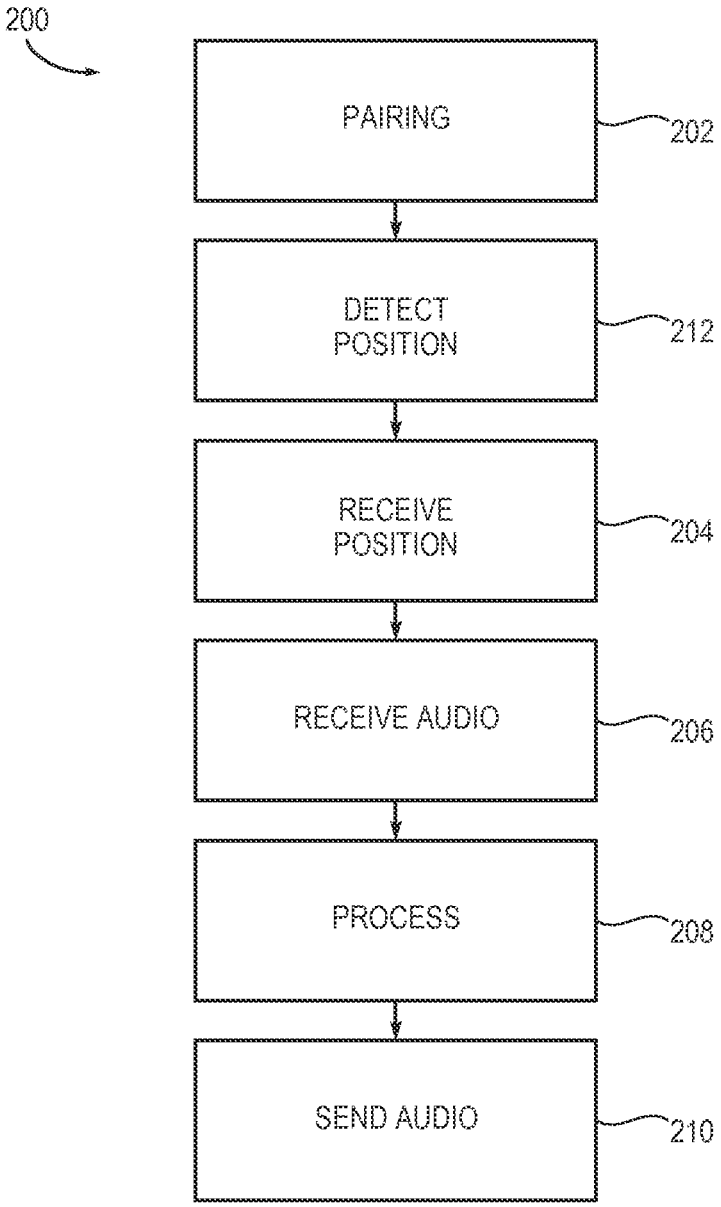
FIG. 6 is a flow diagram for an exemplary method for operating an audio system.

FIG. 6 shows a flow diagram of an exemplary method 200 of operating an audio system. The method 200 comprise pairing with a hearing device 202, receiving position data of the hearing device 204, receiving input signal(s) from audio source(s) 206, processing input signal(s) based on position data to form wireless output signal(s) 208, sending audio stream(s) to the hearing device based on the wireless output signal(s) 210.

Pairing 202 with a hearing device may comprise pairing the hearing device with one or more audio sources of the audio system. Pairing 202 with the hearing device may further comprise exchanging hearing device identification data, audio system identification data and/or audio source identification data, between the hearing device and the audio system.

Receiving 204 position data of the hearing device may comprise continuously receiving updated position data. Alternatively or additionally, receiving 204 position data of the hearing device may comprise receiving position data if the position data has changed. The position data received is indicative of the hearing device position.

Receiving 206 input signal(s) from audio source(s) may include receiving a first input signal from a first audio source and/or receiving a second input signal from a second audio source.

Processing 208 the input signal(s) based on position data to form wireless output signal(s) may include processing of a first input signal based on position data to form a first wireless output signal and/or processing of a second input signal based on position data to form a second wireless output signal. Alternatively, a plurality of input signals may be processed based on position data to form a first wireless output signal.

Sending 210 audio stream(s) to the hearing device based on wireless output signal(s) may include sending a first audio stream to the hearing device based on a first wireless output signal and/or sending a second audio stream to the hearing device based on a second wireless output signal.

Optionally, the method 200 comprises obtaining 212 position data of audio source(s), e.g. between pairing 202 with a hearing device and receiving 204 position data of the hearing device 204. The audio source(s) may be movable, and thus it may be beneficial to obtain or detect position data of the audio source(s) 212, and include the position data of the audio sources in the processing of the input signal(s) 208.

The processing 208 of the input signal(s) to form wireless output signal(s) may be based on position data from the hearing device and/or position data from the audio source(s).

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

2 hearing device
4 first antenna
6 first transceiver
8 primary processing unit
10 acoustic output transducer
12 position controller
14 microphone
16 secondary processing unit
18 first input of secondary processing unit
20 second input of secondary processing unit
22 motion detector
24 position estimator
26 first hearing device
28 second hearing device
30, 30' audio system
32 first audio source
32' second audio source
33 central unit
34 first antenna
35 interface
36 first transceiver
38 processing unit
42 second antenna
44 second transceiver
50 input signal (audio system)
52 wireless output signal
54 audio stream
56 wireless input signal
58 audio input signal
60 input signal (hearing device)
62 output signal
64 audio output signal
66 position data output signal
68 wireless position data signal
70 position data input signal
100, 100' method for operating a hearing device
102 pair with an audio system
104 initiate detection of hearing device motion
106 send position data
108 receive audio stream(s)
110 convert audio stream(s) to wireless input signal(s)
112 mix wireless input signal(s) with audio input signal(s) to form input signal(s)
114 process the input signal(s) to form output signal(s)
116 converting output signal(s) to audio output signal(s)
118 fulfillment of a position change criterion
200 method for operating an audio system
202 pair with a hearing device
204 receive position data of the hearing device
206 receive input signal(s) from audio source(s)
208 process input signal(s) based on position data to form wireless output signal(s)
210 send audio stream(s) to the hearing device based on wireless output signal(s)
212 detecting position data of audio source(s)

The invention claimed is:

1. A method of operating a hearing device comprising a first antenna, a first transceiver coupled to the first antenna, an acoustic output transducer, a microphone, and a processing unit, the processing unit being coupled to the first transceiver, the acoustic output transducer, and the microphone, the method comprising:

pairing the hearing device with an audio system;

initiating detection of a motion or a position of the hearing device;

sending position data indicative of the position of the hearing device to the audio system;

wirelessly receiving a first audio stream based on the position data;

converting the first audio stream to a first wireless input signal;

mixing the first wireless input signal with an audio input signal from the microphone of the hearing device to form a mixed signal;

processing the mixed signal to form an output signal; and converting the output signal to an audio output signal;

wherein the position data is sent to the audio system if a position change criterion is fulfilled to thereby reduce power consumption of the hearing device.

2. The method according to claim 1, wherein the act of initiating the detection of the motion or the position of the hearing device comprises setting up a reference coordinate system.

3. The method according to claim 1, wherein the position data comprises angular position data of the hearing device.

4. The method according to claim 1, wherein the position data are sent via the first transceiver.

5. The method according to claim 1, wherein the hearing device comprises a second antenna, the first antenna and the second antenna being associated with a housing of the hearing device, wherein the first audio stream is received by the hearing device via the first antenna, and wherein the position data are sent via the second antenna.

6. The method according to claim 1, wherein the hearing device comprises a second antenna, the first antenna and the second antenna being associated with a housing of the hearing device, wherein the first audio stream is received by the hearing device via the first antenna, and wherein the act of pairing the hearing device with the audio system is performed via the second antenna.

7. A hearing device comprising:

a first antenna;

a first transceiver coupled to the first antenna and configured to wirelessly receive one or more audio streams from an audio system, the one or more audio streams including a first audio stream, wherein the hearing device is configured for pairing the hearing device with the audio system;

a microphone;

a primary processing unit configured for processing an input signal according to a hearing prescription in order to alleviate a hearing loss;

an acoustic output transducer coupled to the primary processing unit for conversion of an output signal from the primary processing unit into an audio output signal;

a secondary processing unit with a first input and a second input, wherein the first input is coupled to an output of the first transceiver for receiving a first wireless input signal representative of the first audio stream, and the second input is coupled to an output of the microphone for receiving an audio input signal from the microphone, wherein the secondary processing unit is configured to mix the first wireless input signal and the audio input signal to form a mixed signal, and wherein the secondary processing unit has an output for providing the mixed signal to the primary processing unit; and a position controller configured for detecting and sending position data of the hearing device to the audio system;

wherein the position controller is configured to send the position data if a position change criterion is fulfilled.

8. The hearing device according to claim 7, wherein the position controller comprises a motion detector and a position estimator connected to the motion detector, the position estimator configured to estimate the position data of the hearing device based on an output from the motion detector.

9. A method of operating an audio system comprising one or more audio sources including a first audio source, the audio system comprising a first antenna, a first transceiver coupled to the first antenna, and a processing unit, the processing unit being coupled to the first transceiver, the method comprising:

pairing the audio system with a hearing device;

receiving position data indicative of a position of the hearing device;

receiving input signal(s) from the one or more audio sources including a first input signal from the first audio source;

processing the input signal(s) based on the position data to form a first output signal;

sending a first audio stream to the hearing device based on the first output signal; and mixing the first audio stream with an audio input signal from a microphone of the hearing device to form a mixed signal;

wherein the position data is received if a position change criterion is fulfilled.

10. The method according to claim 9, further comprising obtaining position data of the first audio source;

wherein the act of processing the input signal(s) is also based on the position data of the first audio source.

11. The method according to claim 10, wherein the one or more audio sources comprise a second audio source, wherein the act of receiving the input signal(s) from the one or more audio sources comprises receiving a second input signal from the second audio source, and wherein the first output signal is based on the first input signal and the second input signal.

12. The method according to claim 11, further comprising obtaining position data of the second audio source;

wherein the act of processing the input signal(s) comprises processing the first input signal from the first audio source and the second input signal from the second audio source, and wherein the act of processing the input signal(s) is also based on the position data of the second audio source.

13. The method according to claim 9, wherein the hearing device is a binaural hearing device comprising a first hearing device and a second hearing device;

wherein the first output signal comprises a first primary output signal and a first secondary output signal; and wherein the act of sending the first audio stream to the hearing device comprises sending the first primary audio stream to the first hearing device and sending the first secondary audio stream to the second hearing device.

14. The method according to claim 1, wherein the position data is sent from the hearing device to the audio system.

15. The method according to claim 9, wherein the position data indicative of the position of the hearing device is received from the hearing device.

16. The method according to claim 1, further comprising determining a positional change based on the position of the hearing device, and determining whether the positional change fulfills the position change criterion.

17. The method according to claim 1, wherein the position change criterion comprises an angle change threshold.

18. The hearing device according to claim 7, wherein the hearing device is configured to determine a positional change based on a position of the hearing device, and determine whether the positional change fulfills the position change criterion.

19. The hearing device according to claim 7, wherein the position change criterion comprises an angle change threshold.

* * * * *